US007174843B1

(12) United States Patent
Tossavainen

(10) Patent No.: US 7,174,843 B1
(45) Date of Patent: Feb. 13, 2007

(54) HYDROFOIL UNIT FOR ATTACHING TO THE STERN OF THE HULL OF A BOAT

(76) Inventor: Raimer E. Tossavainen, P.O. Box 188, Lakebay, WA (US) 98349

( * ) Notice: Subject to any disclaimer, the term of this patent is extended or adjusted under 35 U.S.C. 154(b) by 0 days.

(21) Appl. No.: 11/254,193

(22) Filed: Oct. 19, 2005

(51) Int. Cl.
*B63B 1/22* (2006.01)
*B63B 1/24* (2006.01)

(52) U.S. Cl. ..... 114/284; 114/280; 114/285

(58) Field of Classification Search ..... 114/271, 114/274, 280–286, 288–291, 145 R, 145 A; D12/309
See application file for complete search history.

(56) References Cited

U.S. PATENT DOCUMENTS 2,832,304 A * 4/1958 Elyosius et al. ..... 114/280
3,370,561 A * 2/1968 Erland ..... 114/285
3,391,667 A * 7/1968 Lo ..... 114/285
4,967,682 A * 11/1990 O'Donnell ..... 114/286
6,805,068 B1 * 10/2004 Tossavainen ..... 114/274

FOREIGN PATENT DOCUMENTS

EP 50176 A1 * 4/1982
JP 01212695 A * 8/1989

* cited by examiner

*Primary Examiner*—Ajay Vasudeva
(74) *Attorney, Agent, or Firm*—Richard L. Miller

(57) ABSTRACT

A hydrofoil unit for attaching to the stern of the hull of a boat. The unit includes a mount that mounts to the stern of the hull of the boat, a hydrofoil that is pivotally attached to the mount, a pivot assembly that pivotally attaches the hydrofoil to the mount, and apparatus for pivoting the hydrofoil relative to the mount. In one embodiment, the apparatus is automatic and includes an hydraulic cylinder that is pivotally attached to the transom of the boat and a strut that is pivotally attached to the hydraulic cylinder and the hydrofoil. In another embodiment, the apparatus is manual and includes an upper threaded rod that is pivotally attaching to the transom of the boat, a turnbuckle that is attached to the upper threaded rod, and a lower threaded rod that is attached to the turnbuckle and the hydrofoil.

23 Claims, 3 Drawing Sheets

HYDROFOIL UNIT FOR ATTACHING TO THE STERN OF THE HULL OF A BOAT

BACKGROUND OF THE INVENTION

1. Field of the Invention

The present invention relates to a hydrofoil unit, and more particularly, the present invention relates to a hydrofoil unit for attaching to the stern of the hull of a boat.

2. Description of the Prior Art

Numerous innovations for hydrofoil units have been provided in the prior art that will be described. Even though these innovations may be suitable for the specific individual purposes to which they address, however, they differ from the present invention.

A FIRST EXAMPLE, U.S. Pat. No. 6,805,068 B1 issued on 10-19-2004 to Tossavainen teaches a hydrofoil system for lifting a boat out of water an amount sufficient to reduce drag while still allowing the boat to be powered by a conventional inboard-outboard drive. The hydrofoil system includes a front hydrofoil unit, a center hydrofoil unit, and a pair of rear hydrofoil units. The front hydrofoil unit includes a hydrofoil portion that dependingly mounts to a mounting portion thereof that depends from the bottom of the hull at the bow thereof. The center hydrofoil unit includes a hydrofoil that dependingly extends equidistantly outwardly from a pair of stanchions thereof that depend from the bottom of the hull at the substantial center thereof. Each rear hydrofoil unit includes a hydrofoil that dependingly extends equidistantly outwardly from a pair of stanchions thereof that depend from port and starboard trim tab units of the hull, respectively.

It is apparent that numerous innovations for hydrofoil units have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, it is an object of the present invention to provide a hydrofoil unit for attaching to the stern of the hull of a boat that avoids the disadvantages of the prior art.

Briefly stated, another object of the present invention is to provide a hydrofoil unit for attaching to the stern of the hull of a boat. The unit includes a mount that mounts to the stern of the hull of the boat, a hydrofoil that is pivotally attached to the mount, a pivot assembly that pivotally attaches the hydrofoil to the mount, and apparatus for pivoting the hydrofoil relative to the mount. In one embodiment, the apparatus is automatic and includes an hydraulic cylinder that is pivotally attached to the transom of the boat and a strut that is pivotally attached to the hydraulic cylinder and the hydrofoil. In another embodiment, the apparatus is manual and includes an upper threaded rod that is pivotally attaching to the transom of the boat, a turnbuckle that is attached to the upper threaded rod, and a lower threaded rod that is attached to the turnbuckle and the hydrofoil.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

First Embodiment

Figure 1:
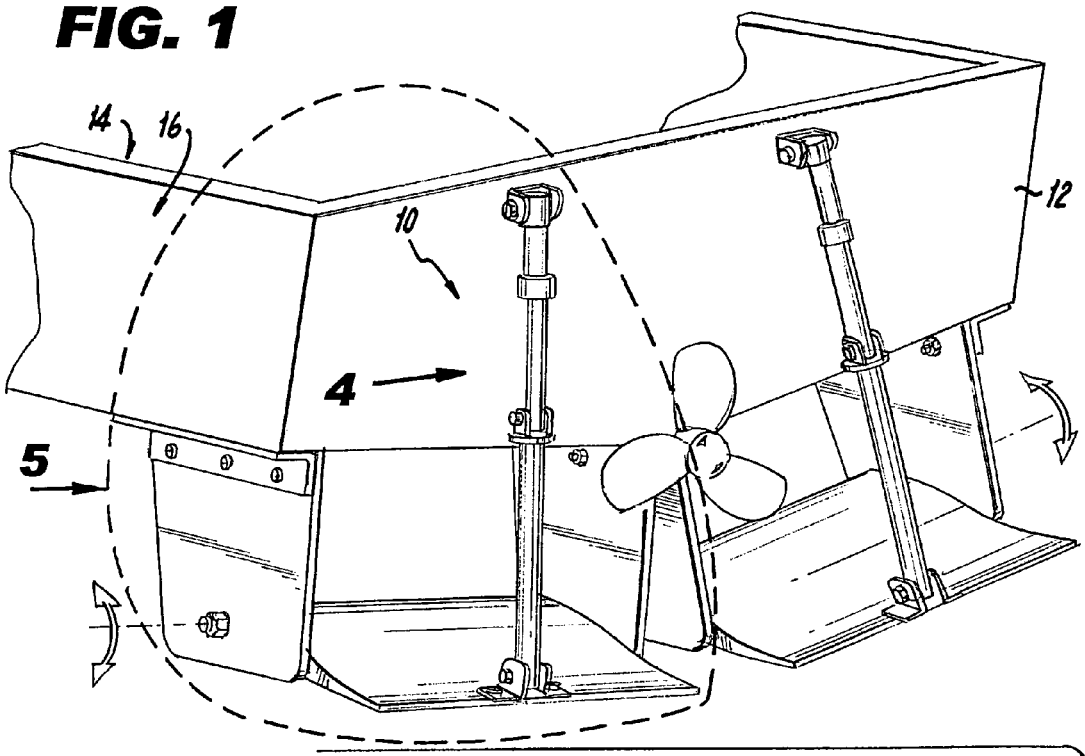
FIG. 1 is a diagrammatic perspective view of a first embodiment of the hydrofoil unit of the present invention attached to the stern of the hull of a boat.

10 hydrofoil unit of present invention for attaching to stern 12 of hull 14 of boat 16
12 stern of hull 14 of boat 16
14 hull of boat 16
16 boat
18 mount for mounting to stern 12 of hull 14 of boat 16
20 hydrofoil
22 pivot assembly
24 pivoting apparatus for pivoting hydrofoil 20 relative to mount 18
26 pair of stanchions of mount 18 for being dependingly attached to stern 12 of hull 14 of boat 16
28 plate of each stanchion of pair of stanchions 26 of mount 18
30 upper edge of plate 28 of each stanchion of pair of stanchions 26 of mount 18
32 angle iron of mount 18 for attaching to stern 12 of hull 14 of boat 16
34 trailing edge of hydrofoil 20
36 pair of sides of hydrofoil 20
38 hydraulic cylinder of pivoting apparatus 24
40 strut of pivoting apparatus 24
42 coupling of pivoting apparatus 24
44 upper end of hydraulic cylinder 38 of pivoting apparatus 24 for pivotally attaching to transom of boat 16
46 lower end of hydraulic cylinder 38 of pivoting apparatus 24
48 upper end of strut 40 of pivoting apparatus 24
50 lower end of strut 40 of pivoting apparatus 24
51 yoke of upper end 48 of strut 40 of pivoting apparatus 24
52 pair of bosses of pivoting assembly 22
54 pair of threaded studs of pivot assembly 22
56 pair of bushings of pivot assembly 22
58 pair of nuts of pivot assembly 22

60 through bores in pair of stanchions 26 of mount 18, respectively

Second Embodiment

110 hydrofoil unit
124 pivoting apparatus
138 upper threaded rod of pivoting apparatus 124
140 lower threaded rod of pivoting apparatus 124
144 upper end of upper threaded rod 138 of pivoting apparatus 124 for pivotally attaching to transom of boat 16
146 lower end of upper threaded rod 138 of pivoting apparatus 124
148 upper end of lower threaded rod 140 of pivoting apparatus 124
150 lower end of lower threaded rod 140 of pivoting apparatus 124
162 turnbuckle of pivoting apparatus 124
164 upper end of turnbuckle 162 of pivoting apparatus 124
166 lower end of turnbuckle 162 of pivoting apparatus 124

DETAILED DESCRIPTION OF THE PREFERRED EMBODIMENT

Figure 2:
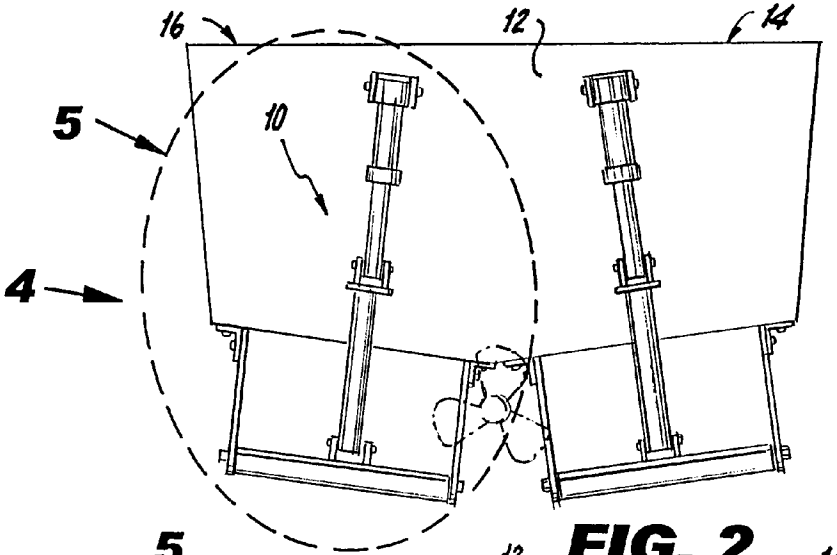
FIG. 2 is a diagrammatic rear elevational view of a first embodiment of the hydrofoil unit of the present invention attached to the stern of the hull of a boat having a shallow hull.
Figure 3:
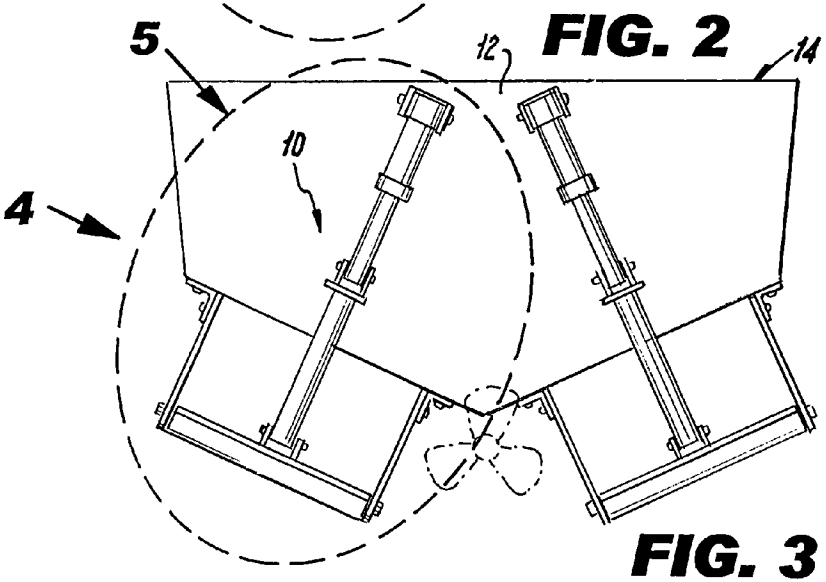
FIG. 3 is a diagrammatic rear elevational view of a first embodiment of the hydrofoil unit of the present invention attached to the stern of the hull of a boat having a deep hull.

Referring now to the figures, in which like numerals indicate like parts, and particularly to FIGS. 1–4, which are, respectively, a diagrammatic perspective view of a first embodiment of the hydrofoil unit of the present invention attached to the stern of the hull of a boat, a diagrammatic rear elevational view of a first embodiment of the hydrofoil unit of the present invention attached to the stern of the hull of a boat having a shallow hull, a diagrammatic rear elevational view of a first embodiment of the hydrofoil unit of the present invention attached to the stern of the hull of a boat having a deep hull, and an enlarged diagrammatic side elevational view taken generally in the directions of ARROWS 4 in FIGS. 1–3, a first embodiment of the hydrofoil unit of the present invention is shown generally at 10 for attaching to the stern 12 of the hull 14 of a boat 16.

Figure 5:
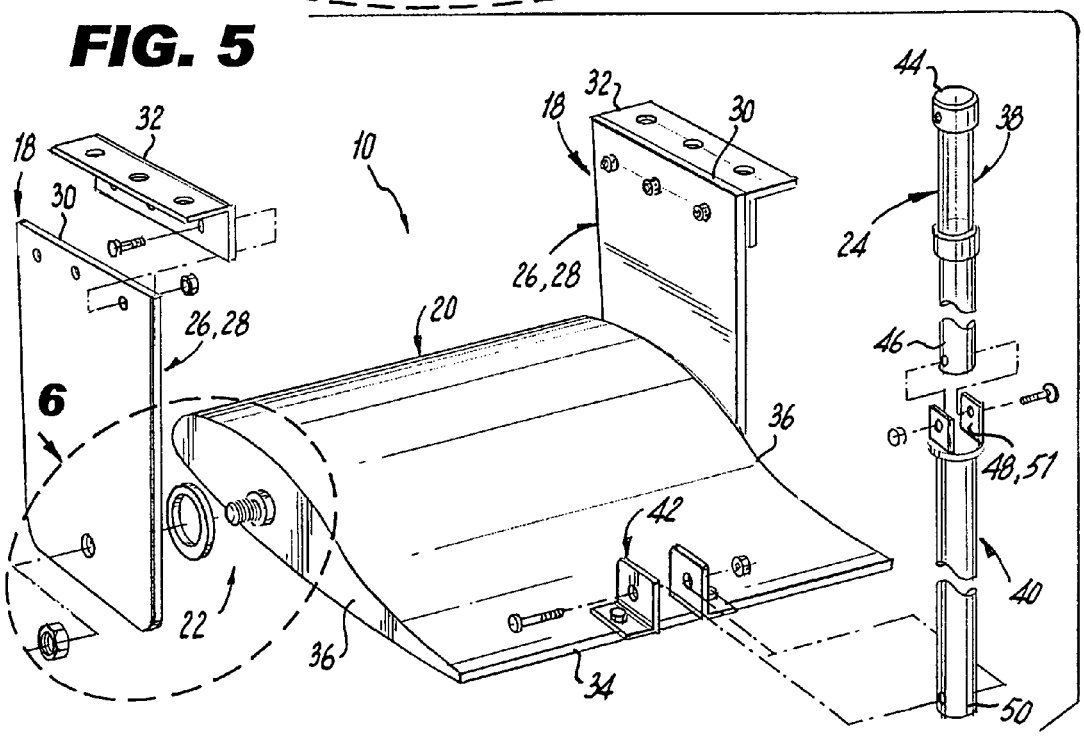
FIG. 5 is an exploded diagrammatic perspective view of the area generally enclosed by the dotted curves identified by ARROWS 5 in FIGS. 1–4 of a first embodiment of the hydrofoil unit of the present invention.

The configuration of the hydrofoil unit 10 can best be seen in FIG. 5, which is an exploded diagrammatic perspective view of the area generally enclosed by the dotted curves identified by ARROWS 5 in FIGS. 1–4 of a first embodiment of the hydrofoil unit of the present invention, and as such, will be discussed with reference thereto.

The hydrofoil unit 10 comprises a mount 18, a hydrofoil 20, a pivot assembly 22, and pivoting apparatus 24. The mount 18 is for mounting to the stern 12 of the hull 14 of the boat 16. The hydrofoil 20 is pivotally attached to the mount 18. The pivot assembly 22 pivotally attaches the hydrofoil 20 to the mount 18. The pivoting apparatus 24 is for pivoting the hydrofoil 20 relative to the mount 18.

The mount 18 comprises a pair of stanchions 26. The pair of stanchions 26 of the mount 18 are for being dependingly attached to the stern 12 of the hull 14 of the boat 16. Each stanchion 26 of the mount 18 is a plate 28. The plate 28 of each stanchion 26 of the mount 18 has an upper edge 30 onto which an angle iron 32 is attached, which in turn is for attaching to the stern 12 of the hull 14 of the boat 16.

The hydrofoil 20 has a trailing edge 34 and a pair of sides 36. The hydrofoil 20 is pivotally mounted to and between the pair of stanchions 26 of the mount 18 by the pivoting assembly 22, with each side 36 of the hydrofoil 20 facing an associated stanchion 26 of the mount 18.

The pivoting apparatus 24 is automatic and comprises an hydraulic cylinder 38, a strut 40, and a coupling 42. The hydraulic cylinder 38 of the pivoting apparatus 24 has an upper end 44 and a lower end 46. The strut 40 of the pivoting apparatus 24 has an upper end 48 and a lower end 50. The coupling 42 of the pivoting apparatus 24 is attached to the trailing edge 34 of the hydrofoil 20.

The upper end 44 of the hydraulic cylinder 38 of the pivoting apparatus 24 is for pivotally attaching to the transom of the boat 16. The upper end 48 of the strut 40 of the pivoting apparatus 24 is formed into a yoke 51 that has the lower end 46 of the hydraulic cylinder 38 of the pivoting apparatus 24 pivotally attached therein. The lower end 50 of the strut 40 of the pivoting apparatus 24 is pivotally attached in the coupling 42 of the pivoting apparatus 24.

Figure 6:
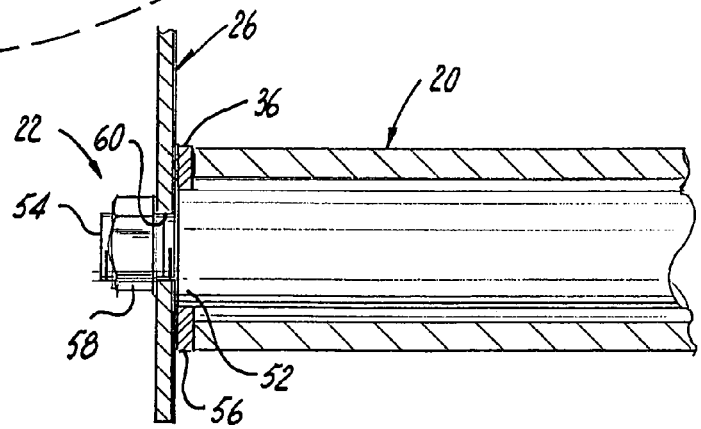
FIG. 6 is an enlarged diagrammatic cross sectional view of the area generally enclosed by the dotted curve identified by ARROW 6 in FIG. 5.

The configuration of the pivot assembly 22 can best be seen in FIG. 6, which is an enlarged diagrammatic cross sectional view of the area generally enclosed by the dotted curve identified by ARROW 6 in FIG. 5, and as such, will be discussed with reference thereto.

The pivot assembly 22 comprises a pair of bosses 52, a pair of threaded studs 54, a pair of bushings 56, and a pair of nuts 58. The pair of bosses 52 of the pivot assembly 22 extend from the pair of sides 36 of the hydrofoil 20, respectively, and receive the pair of bushings 56 of the pivot assembly 22, respectively. The pair of threaded studs 54 of the pivot assembly 22 extend from the pair of bosses 52 of the pivot assembly 22, respectively, and freely through through bores 60 in the pair of stanchions 26 of the mount 18, respectively, where they are threadably received by the pair of nuts 58 of the pivot assembly 22, respectively.

Figure 7:
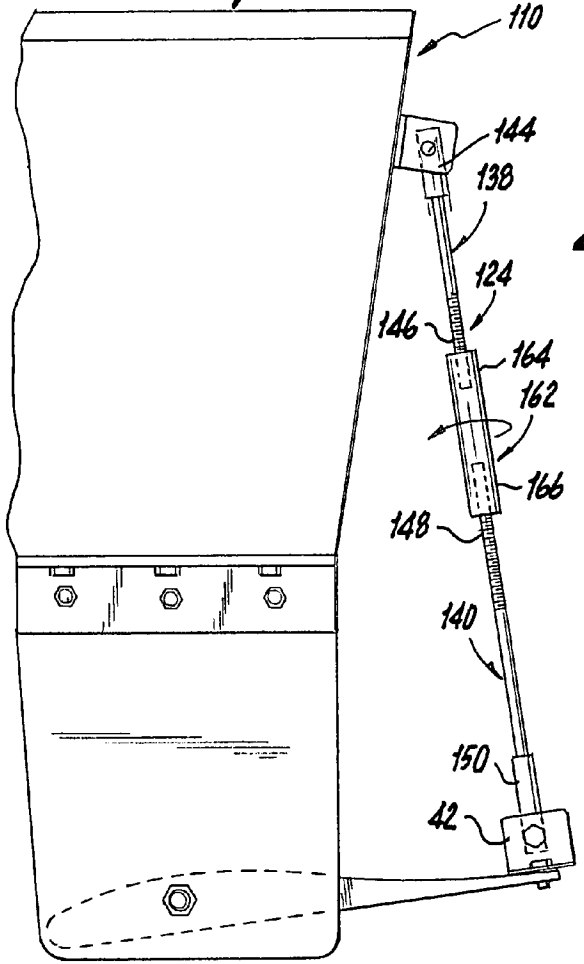
FIG. 7 is a diagrammatic side elevational view of a second embodiment of the hydrofoil unit of the present invention attached to the stern of the hull of a boat.
Figure 4:
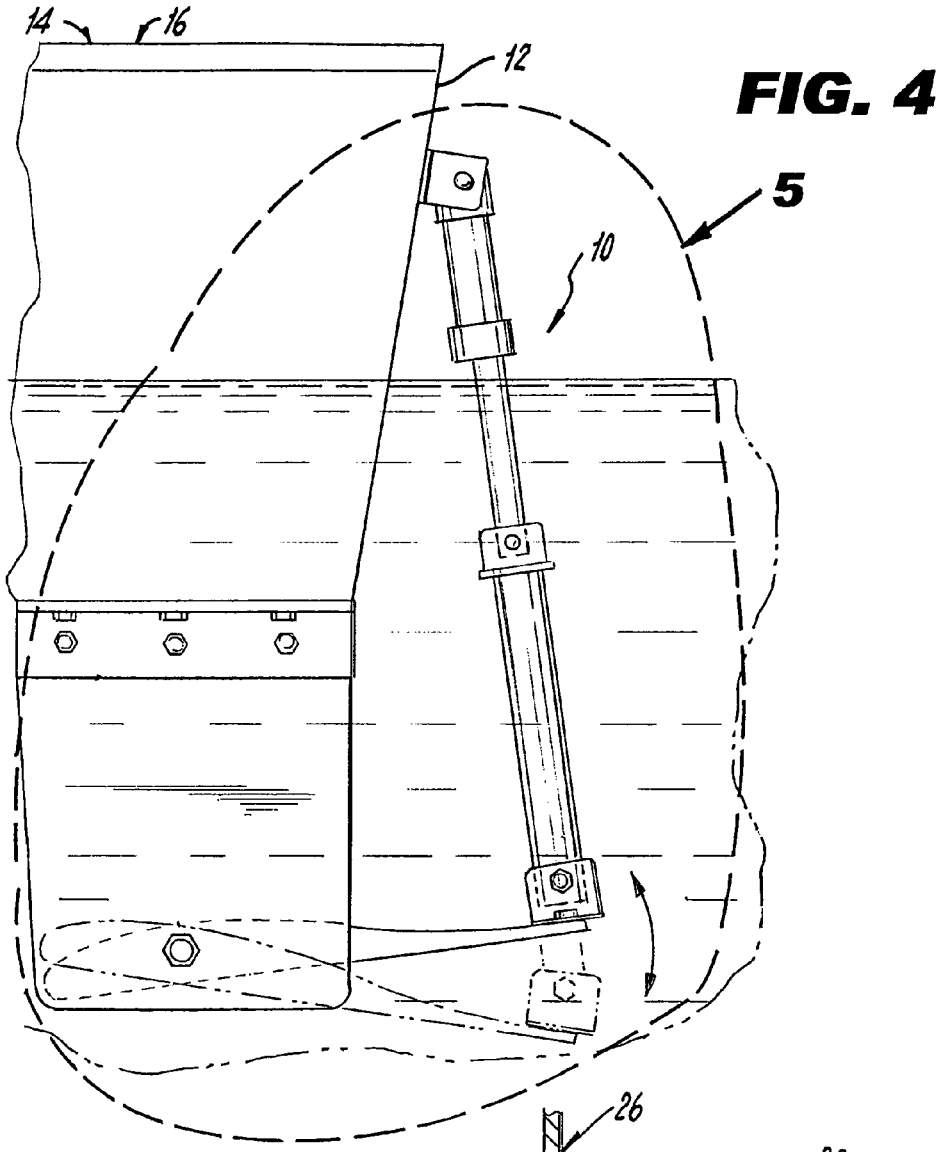
FIG. 4 is an enlarged diagrammatic side elevational view taken generally in the directions of ARROWS 4 in FIGS. 1–3.

The configuration of a second embodiment of the hydrofoil unit 110 can best be seen in FIG. 7, which is a diagrammatic side elevational view of a second embodiment of the hydrofoil unit of the present invention attached to the stern of the hull of a boat, and as such, will be discussed with reference thereto.

The hydrofoil unit 110 is similar to the hydrofoil unit 10, except for the pivoting apparatus 124. The pivoting apparatus 124 is manual and comprises an upper threaded rod 138, a lower threaded rod 140 and a turnbuckle 162. The upper threaded rod 138 of the pivoting apparatus 124 has an upper end 144 and a lower end 146. The lower threaded rod 140 of the pivoting apparatus 124 has an upper end 148 and a lower end 150. The turnbuckle 162 of the pivoting apparatus 124 has an upper end 164 and a lower end 166.

The upper end 144 of the upper threaded rod 138 of the pivoting apparatus 124 is for pivotally attaching to the transom of the boat 16. The lower end 146 of the upper threaded rod 138 of the pivoting apparatus 124 is threadably received in the upper end 164 of the turnbuckle 162 of the pivoting apparatus 124. The upper end 148 of the lower threaded rod 140 of the pivoting apparatus 124 is threadably received in the lower end 166 of the turnbuckle 162 of the pivoting apparatus 124. The lower end 150 of the lower threaded rod 140 of the pivoting apparatus 124 is pivotally attached in the coupling 42 of the pivoting apparatus 124.

It will be understood that each of the elements described above, or two or more together, may also find a useful application in other types of constructions differing from the types described above.

While the invention has been illustrated and described as embodied in a hydrofoil unit for attaching to the stern of the hull of a boat, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hydrofoil unit for attaching to the stern of the hull of a boat, comprising:

a) a mount;

b) a hydrofoil;

c) a pivot assembly; and d) means for pivoting said hydrofoil relative to said mount; wherein said mount is for mounting to the stern of the hull of the boat; wherein said hydrofoil is pivotally attached to said mount; and wherein said pivot assembly pivotally attaches said hydrofoil to said mount, wherein said mount comprises a pair of stanchions; and wherein said pair of stanchions of said mount are for being dependingly attached to the stern of the hull of the boat, wherein each stanchion of said mount has an upper edge;

wherein said upper edge of each stanchion of said mount has an angle iron attached thereto; and wherein said angle iron of each stanchion of said mount is for attaching to the stern of the hull of the boat, wherein said means includes a coupling, wherein said hydrofoil has a trailing edge; and wherein said coupling of said means is attached to said trailing edge of said hydrofoil.

2. The unit of claim 1, wherein each stanchion of said mount is a plate.

3. The unit of claim 1, wherein said hydrofoil has a pair of sides;

wherein said hydrofoil is pivotally mounted to said pair of stanchions of said mount by said pivoting assembly;

wherein said hydrofoil is pivotally mounted between said pair of stanchions of said mount by said pivoting assembly; and wherein each side of said hydrofoil faces an associated stanchion of said mount.

4. The unit of claim 3, wherein said pivot assembly comprises a pair of bosses.

5. The unit of claim 4, wherein said pivot assembly comprises a pair of bushings.

6. The unit of claim 5, wherein said pair of bosses of said pivot assembly extend from said pair of sides of said hydrofoil, respectively; and wherein said pair of bosses of said pivot assembly receive said pair of bushings of said pivot assembly, respectively.

7. The unit of claim 4, wherein pivot assembly comprises a pair of threaded studs.

8. The unit of claim 7, wherein said pair of threaded studs of said pivot assembly extend from said pair of bosses of said pivot assembly, respectively; and wherein said pair of threaded studs of said pivot assembly extend freely through through bores in said pair of stanchions of said mount, respectively.

9. The unit of claim 7, wherein said pivot assembly comprises a pair of nuts.

10. The unit of claim 9, wherein said pair of threaded studs of said pivot assembly are threadably received by said pair of nuts of said pivot assembly, respectively.

11. The unit of claim 1, wherein said means is automatic.

12. The unit of claim 1, wherein said means includes an hydraulic cylinder;

wherein said hydraulic cylinder of said means has an upper end; and wherein said upper end of said hydraulic cylinder of said means is for pivotally attaching to the transom of the boat.

13. The unit of claim 12, wherein said means includes a strut.

14. The unit of claim 13, wherein said strut of said means has an upper end; and wherein said upper end of said strut of said means is formed into a yoke.

15. The unit of claim 14, wherein said hydraulic cylinder of said means has a lower end; and wherein said yoke of said strut of said means has said lower end of said hydraulic cylinder of said means pivotally attached therein.

16. The unit of claim 13, wherein said strut of said means has a lower end; and wherein said lower end of said strut of said means is pivotally attached in said coupling of said means.

17. The unit of claim 1, wherein said means is manual.

18. The unit of claim 1, wherein said means comprises an upper threaded rod;

wherein said upper threaded rod of said means has an upper end; and wherein said upper end of said upper threaded rod of said means is for pivotally attaching to the transom of the boat.

19. The unit of claim 18, wherein said means includes a turnbuckle.

20. The unit of claim 19, wherein said upper threaded rod of said means has a lower end wherein said turnbuckle of said means has an upper end; and wherein said lower end of said upper threaded rod of said means is threadably received in said upper end of said turnbuckle of said means.

21. The unit of claim 19, wherein said means includes a lower threaded rod.

22. The unit of claim 21, wherein said turnbuckle of said means has a lower end;

wherein said lower threaded rod of said means has an upper end; and wherein said upper end of said lower threaded rod of said means is threadably received in said lower end of said turnbuckle of said means.

23. The unit of claim 21, wherein said lower threaded rod of said means has a lower end; and wherein said lower end of said lower threaded rod of said means is pivotally attached in said coupling of said means.

* * * * *